US005560501A

United States Patent [19]

Rupert

[11] Patent Number: 5,560,501

[45] Date of Patent: Oct. 1, 1996

[54] ARTICULATABLE STORAGE ORGANIZER

[76] Inventor: James C. Rupert, 225 Liberty Hill Rd., Gilford, N.H. 03246

[21] Appl. No.: 433,977

[22] Filed: May 4, 1995

[51] Int. Cl.[6] ..... A47F 5/00

[52] U.S. Cl. ..... 211/99; 211/104; 248/284.1; 312/248

[58] Field of Search ..... 211/1.3, 104, 100, 211/99; 312/246, 247, 248; 248/284.1

[56] References Cited

U.S. PATENT DOCUMENTS

| | | | |
|---|---|---|---|
| 2,460,681 | 2/1949 | Davis | 312/248 X |
| 2,653,071 | 9/1953 | Lundstrom | 248/284.1 X |
| 3,417,874 | 12/1968 | Bryant | 211/100 |
| 3,436,046 | 4/1969 | Valeska | 211/100 X |
| 4,114,764 | 9/1978 | Rich | 211/100 |
| 4,915,461 | 4/1990 | Kingsborough et al. | 312/248 X |
| 5,026,129 | 6/1991 | Merl | 312/248 X |
| 5,224,677 | 7/1993 | Close | 211/104 X |
| 5,228,763 | 7/1993 | Gingold | 312/247 X |
| 5,249,858 | 10/1993 | Nusser | 312/248 X |

*Primary Examiner*—Robert W. Gibson, Jr.
*Attorney, Agent, or Firm*—Stephen W. White

[57] ABSTRACT

A movable storage organizer that can be stored at an elevated level and then easily moved to a lower, using level is described. This organizer, which may be a set of drawers for containing storage items, or may be a clothes hanging facility, is contained within a set of rails that are mounted within a frame connected to the storage position. An articulatable moving means is mounted to the frame and the rails permitting the lowering of the organizer. A spring arrangement attached to said articulatable moving means and the frame assists in the easy return of the organizer from the user level back to the higher, storage level.

4 Claims, 3 Drawing Sheets

ARTICULATABLE STORAGE ORGANIZER

BACKGROUND OF THE INVENTION

1. Field of the Invention

This invention relates to storage units and more specifically to storage units or organizers that can be placed on the shelves of closets and the like. Still more specifically, this invention relates to closet storage units that are easily moved from a higher place to a usable and lower level. Even more specifically, this invention relates to closet storage units that can be articulatably moved from a high, storage position to a lower, more user friendly position.

2. Description of the Prior Art

There are a host of storage and organizer devices described by the prior art and designed to be used within closed or limited spaces. Many of these have both industrial and consumer uses, for example. Although there are reports of such organizer devices that are movable, none describe devices that can be easily moved from a higher to a much lower, user friendly level. There are also a host of well-known closet storage and organizer units offered by the prior art. These are usually placed within the closet on the lower (e.g. ground) level so as to provide easy access to the elements stored therein. These prior art devices take up valuable clothes storage areas within the closet and are not designed to be moved to a higher or a lower position and thus are not particularly useful. There are other devices described by the prior art that are placed on the upper shelves of the closet, for example. Although these units are useful for the storage of elements, they are difficult to reach and thus must be either reached from a stool or ladder or lifted down from the storage position to the using position. Most of these so-called closet storage devices thus are not very useful for long-term storage and to improve the efficacy of the closet itself. Additionally, with those who are either physically challenged or have some difficulty in reaching for higher storage, there are essentially no storage organizers to solve their problems.

SUMMARY OF THE INVENTION

It is an object of this invention to provide a useful and unique storage and organizer device. It is yet another object of this invention to provide as useful and unique storage and organizer device that can be used within the confines of a closet. Still more specifically, it is an object of this invention to provide a useful and unique closet storage and organizer device that is articulatably designed to be moved from one position to another. It is also an object of this invention to provide a useful and unique closet storage and organizer device that is articulatably designed to move from a higher, storage position to a lower user position within said closet. Finally, it is an object of this invention to provide an articulatably movable storage organizer that is particularly useful for users who are physically challenged and thus cannot access prior art storage organizers and the like. These and yet other objects are achieved in a storage organizer mounted in a frame at an elevated position, said organizer comprising at least one containing unit connectably mated within said frame at said elevated position to side, top and bottom rails, said side, top and bottom rails having articulatable moving means connected to said frame and said rails, and a spring means connected to said frame and said articulated moving means, whereby when said moving means is actuated, said containing unit is lowered to a position below said elevated position.

DETAILS OF THE INVENTION

Closets can become messy places since there is a tendency by the users to store a host of clothing and other items therein. As previously mentioned, storage organizers, especially those used within these closets and the like, are particularly useful. When the organizer is located at an elevated position, it is difficult to locate the desired item contained therein without a step stool or ladder. Thus, there is a pressing need to provide a storage organizer that can be used to contain a plurality of items for long or near term storage and yet can be easily reached for use. This need is accentuated for those who are physically challenged or are of lesser height than normal or who have some age induced disability, for example. The device of this invention solves many of these problems as can be seen by the drawings contained within the figures included herewith.

Figure 1:
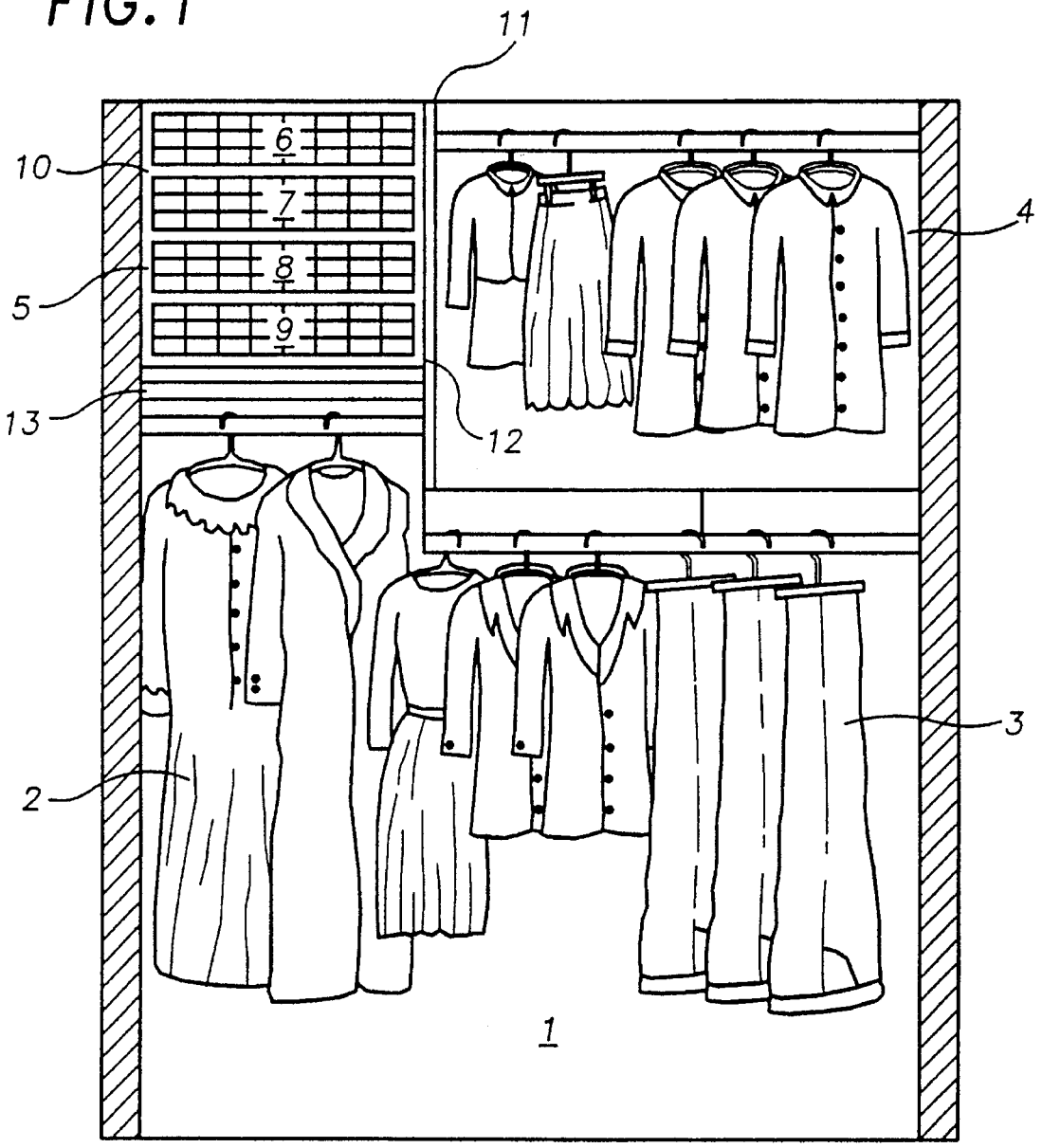
FIG. 1 is front view of a typical closet showing the storage organizer of this invention at a higher level within the closet.

Looking now specifically at the Figures, FIG. 1 is a frontal view of a typical closet containing clothes hanging therein. In this figure, the closet 1 is open and the doors are not shown. Clothes are hanging within the closet at several locations shown as 2, 3, and 4. At 5 there is shown one variation of the storage organizer of this invention. Within this embodiment that particular organizer contains four (4) containing units shown as drawers 6, 7, 8, and 9. In yet another embodiment, the area shown as 4 may also be a storage organizer designed to hold hanging clothes, for example. Rails are shown as 10, **10*a*, 11, 11*a*, 12, and 12*a* surrounding the four (4) storage units and the area 4 with the hanging clothes. The bottom or shelf of a supporting unit is shown as 13 and 13*a*** in this figure.

Figure 2:
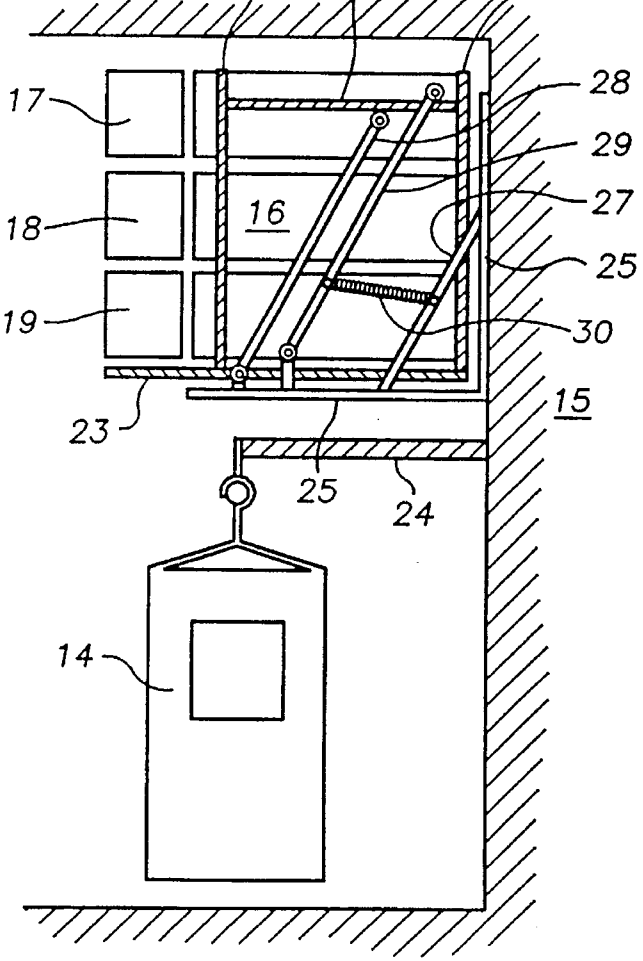
FIG. 2 is a side view cut-away showing of the closet of FIG. 1. In this view, the storage organizer is shown in somewhat more detail.

FIG. 2 is a side and cut-away view of a closet. In this figure, clothes are shown hanging at 14 and the rear wall of the closet is shown as 15. The storage organizer unit is shown as 16 and in this arrangement contains three (3) containing units shown as drawers 17, 18 and 19. A front supporting rail is located at 20, a top supporting rail at 21, a rear support rail at 22 and a bottom supporting rail at 23. These rails surround these three (3) containing units and are supported by a bottom shelf 25 and a wall support 26 which is affixed to the rear wall of the closet 15. (Affixing means not shown in this figure.) The bottom shelf may be further reinforced by an angle support shown here as 27. An articulating lowering means is shown here as a pair of rotating bars 28 and 29 which are attached to the top supporting rail 21 and then again to the bottom shelf 25.

These rotating bars permit the storage unit to be pulled out away from the rear wall of the closet and towards the open door and at the same time to be lowered into a position which is more user friendly. A returning spring 30 permits the user to gently push the unit back up to its storage position, shown in this particular figure. A means for hanging the clothes is shown as 24.

Figure 3:
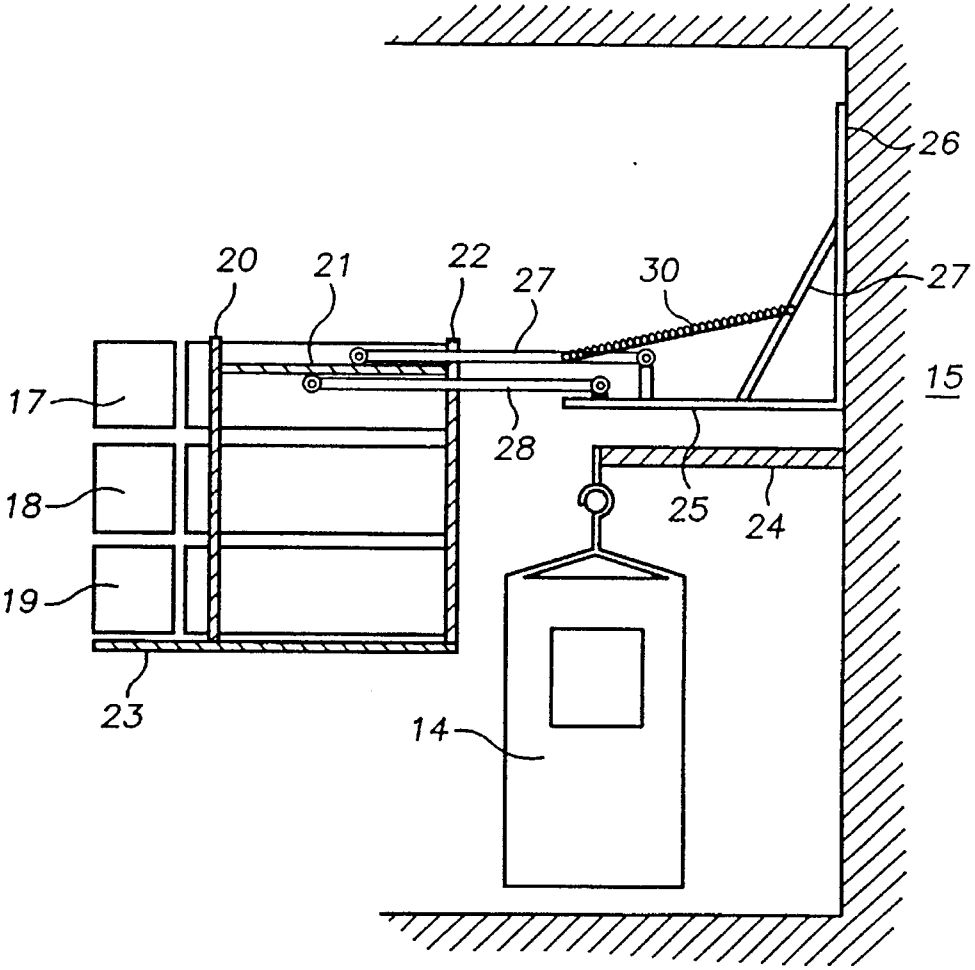
FIG. 3 is a showing of FIG. 2 in which the storage organizer has been moved down to a lower, user level for access to the contents thereof. In this view, additional details of the articulatable moving means for moving the storage organizer from the elevated level to this lower, user level are shown.

FIG. 3 shows the storage unit of FIG. 2 in the user friendly and lower position described above. At this position, the user can easily reach into drawers 17, 18 or 19 and when finished, push the storage unit back into its higher, storage position.

Figure 4:
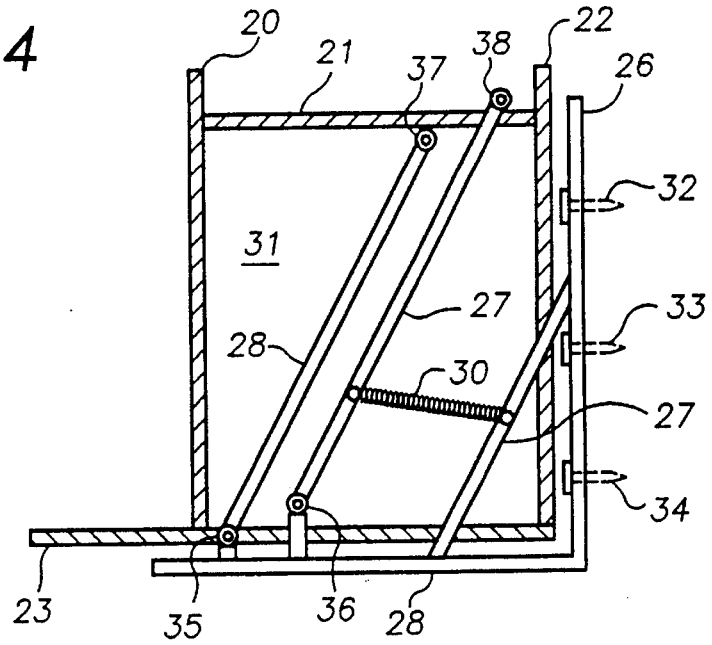
FIG. 4 the storage organizer of this invention without storage units shown in the closed, elevated position. Some details of the means to raise and lower this organizer/ban be seen here.

In FIG. 4, the storage unit of this invention is shown in a side, larger view and without the containing units enclosed therewith. In this showing, the area which would normally hold the containing units is shown as 31 which is surrounded by front supporting rail 20, top supporting rail 21, rear support rail 22 and bottom supporting rail 23. The bottom shelf 25 and the wall support 26 along with angle support 27 further surround and support the rail system described above. In this figure, three connecting bolts 32, 33 and 34 are shown. These bolts can be used to connect the entire storage unit to the rear wall of the closet (not shown in this figure). Rotating bars 28 and 29 are clearly shown attached at the top of top supporting rail 21 and at the lower end to the bottom shelf 25. Four (4) rollers 35, 36, 37 and 38 are provided for these attachments. The returning spring 30 is connected to rotating bar 28 and angle support 27. It must be remembered that in this figure, as well as the other, side-view figures contained within this invention, only one-half of the element is shown. An exact duplicate of these items will be contained on the other side of the figure. Within this figure, the rails are in the up and closed storage position.

Figure 5:
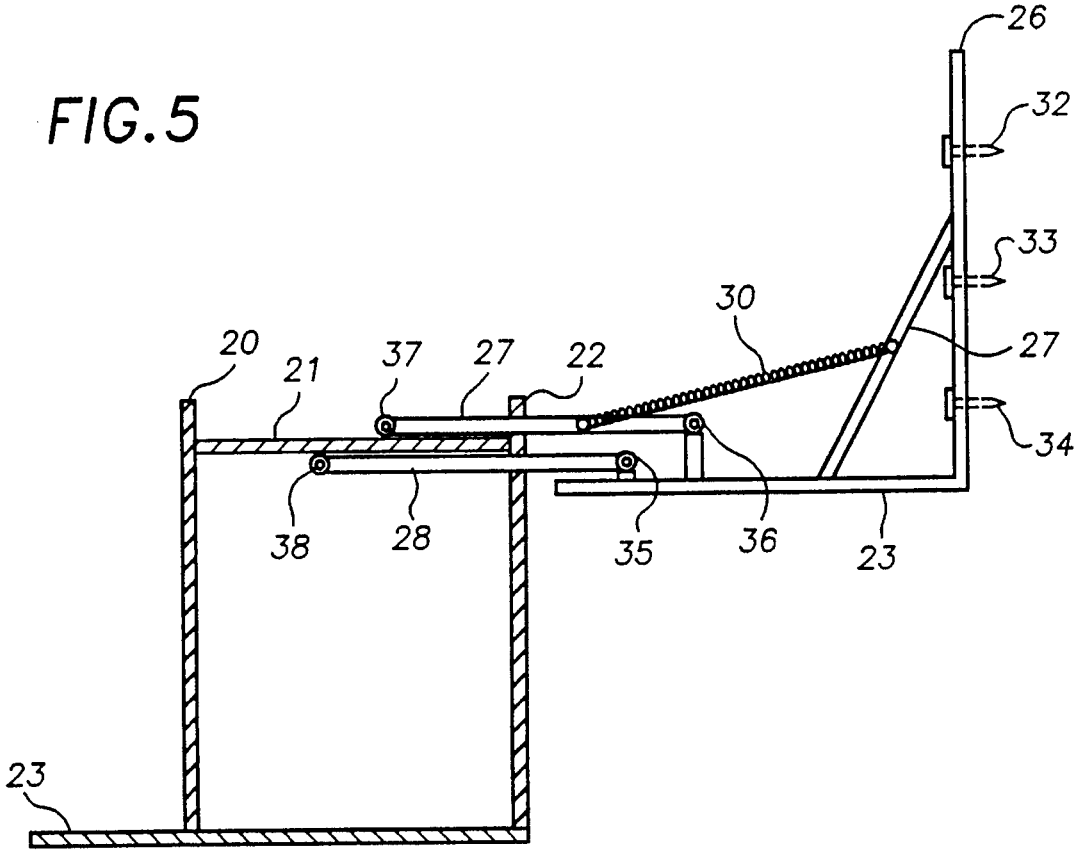
FIG. 5 is the same as FIG. 4 but with the storage organizer shown in the open, lowered position.

FIG. 5 is the same as FIG. 4 but with the storage unit in its lower, useful position. Here, the various operations of rotating bars 28 and 29 can be clearly seen. The returning spring 30 has been stretched out to its full length by the lowering action. When it is necessary to return the storage unit to its higher, storage position, an upwards pushing action on the unit will be assisted by the returning spring and it is this spring that will actuate the return motion.

The storage unit or device of this invention may be made from a host of available construction materials. Metals such as steel, iron, aluminum, etc., are useful as well as wire. Also to be mentioned is wood and the like. The materials of construction are not essential to the operation of the device of this invention. In one preferred version, the containing units may be made from plastic coated wire mesh.

The articulated moving means for raising and lowering the device of this invention may be other than that described above. For example, a series of springs and slides may also be used. In this particular mode, the containing units could slide out from the rails and pop into a grooved slide arrangement attached to the ceiling of the closet, for example. A series of springs connected to the containing units and also connected to the rear, upper area of the closet would permit easy lowering and raising of the containers from one position to the other. There are a host of articulatable means that are known and that can be used within the metes and bounds of this invention. The articulated moving means may also include some sort of motorized arrangement in order to facilitate even further the operation of the device of this invention. For example, a motor may be attached with a pulling means to the storage organizer of this invention. This motor may be actuated by a switch so that the entire device is lowered and raised without further action by the user.

A preferred embodiment is shown within the figures attached to this invention and described above. Within this mode, the device of this invention is shown stored within a closet, for example. However, the device does not require a closet to function. For example, the device of this invention might be used within a kitchen area and in its stored position be located above the normal kitchen cabinets. Again, the device of this invention might be found within an office area or within some other storage area such as an attic, upper hallway, basement and the like. Or, it might be used within a free-standing cabinet and thus increase the utility thereof. For example, the device of this invention might be contained in an entertainment center and provide useful, elevated storage for books, records, CD's, videos, etc. Thus, the entertainment center could be designed to be higher than normal since the storage area could be accessible by using the device of this invention therein.

I do not mean to be held by the various figures and descriptions contained herein. The element and essence of my invention is to provide a useful storage device that can be held at a higher, stored level yet that can be easily accessed at a lower, using level following the teachings of my invention.

I claim:

1. A storage organizer mounted in a frame, said frame comprising a bottom shelf, a wall support and an angle support connected between said bottom shelf and said wall support, said frame being positioned at an elevated position, said organizer comprising a set of drawers mounted therein and connectably mated within said frame at said elevated position to side, top and bottom rails, said side, top and bottom rails having an articulatable moving means connected to said shelf support of said frame and said top rail, and a spring means connected to said angle support of said frame and said articulatable moving means, whereby when said storage organizer is actuated by pulling, said drawers are lowered to a position below said elevated position.

2. The storage organixeer of claim 1 having three or more drawers.

3. The storage organizer of claim 1 wherein said frame elements are contained within a closet.

4. The storage organizer of claim 3 wherein said wall support of said frame is connected to the rear wall of the closet at an elevated position.

* * * * *